United States Patent [19]

Carlzon

[11] Patent Number: 5,060,866

[45] Date of Patent: Oct. 29, 1991

[54] DEVICE AT WASHING AND RINSING APPARATUSES FOR PRODUCING A FOAM

[76] Inventor: Manne Carlzon, Trässberg Hälledal, S-531 93 Lidkoping, Sweden

[21] Appl. No.: 424,275

[22] PCT Filed: Apr. 27, 1988

[86] PCT No.: PCT/SE88/00215

§ 371 Date: Oct. 26, 1989

§ 102(e) Date: Oct. 26, 1989

[87] PCT Pub. No.: WO88/08333

PCT Pub. Date: Nov. 3, 1988

[30] Foreign Application Priority Data

Apr. 27, 1987 [SE] Sweden ..... 8701705

[51] Int. Cl.[5] ..... B05B 7/04

[52] U.S. Cl. ..... 239/427.5; 239/124; 239/310; 239/428

[58] Field of Search ..... 239/310, 340, 369, 427.5, 239/428, 8, 9, 10, 317, 312, 124

[56] References Cited

U.S. PATENT DOCUMENTS

| | | | |
|---|---|---|---|
| 1,532,809 | 4/1925 | Girard | 239/312 |
| 1,594,641 | 8/1926 | Starr | 239/8 |
| 2,920,579 | 1/1960 | Grimm | 239/310 |
| 2,931,580 | 4/1960 | Johnson | 239/340 |
| 3,201,049 | 8/1965 | Hayes | 239/310 |
| 3,250,476 | 5/1966 | Kenk | 239/317 |
| 3,430,865 | 3/1969 | McDougall | 239/9 |
| 3,473,481 | 10/1969 | Brane | 239/310 |
| 4,505,431 | 3/1985 | Huffman | 239/428 |

FOREIGN PATENT DOCUMENTS

| | | | |
|---|---|---|---|
| 0207501 | 1/1987 | European Pat. Off. | 239/310 |

*Primary Examiner*—Andres Kashnikow
*Assistant Examiner*—Christopher G. Trainor
*Attorney, Agent, or Firm*—Ostrolenk, Faber, Gerb & Soffen

[57] ABSTRACT

A device in washing and rinsing apparatuses for continuously creating a foam, and conveying this to a nozzle (30), which device incorporates an injector (12), the pressure side (14) of which being connectable to a driving medium, e.g. water under pressure, and the suction side of which being connectable to a liquid, foam-forming detergent. The spray nozzle (18) of the injector is designed with an elongated, cross-sectionally very small hole (19), adapted to press the driving medium as a very thin jet into the diffuser (16) of the injector. The diffusor (16) is slightly conical and on the inlet side is provided with a portion of bigger, preferably much bigger cross-sectional area than the hole (19) of the spray nozzle (18). The diffusor (16) is arranged to open into an expansion chamber (20), to which is connectable a pressurized gas, e.g. air, for transport of the foam created therein to the nozzle (30).

7 Claims, 1 Drawing Sheet

DEVICE AT WASHING AND RINSING APPARATUSES FOR PRODUCING A FOAM

The present invention refers to a device in washing and rinsing apparatuses for continuously creating a foam, and conveying this to a nozzle, which device incorporates an injector, to the pressure side of which is connectable a driving medium, e.g. water under pressure, and the suction side of which is connectable to a liquid, foam-forming detergent.

BACKGROUND OF THE INVENTION

When cleansing with washing and rinsing apparatuses it very often occurs that the object to be cleansed must be subjected to cleansing with a chemical detergent during the cleansing procedure. This detergent is usually added to the cleansing liquid, which generally is water, by means of an injector. The detergent thus is admixed with rinsing water, which furthermore may have an increased water pressure, if the washing and rinsing apparatus is a high pressure apparatus. As the addition of the detergent occurs in connection with the rinsing, only a small part of the detergent supplied will actively take part in the dissolving of the dirt. The major part of the detergent is flushed away when the jet of water hits the object to be cleansed. Manual application of the detergent has therefore been resumed, whereby the detergent will have a possibility actively to act upon the layer of dirt.

From U.S. Pat. No. 4,505,431 is earlier known a foam-forming device, wherein water causes injection of a foam-forming fluid in an injector, which is also connected to a source of pressurized air, in such a manner that pressurized air is supplied to an annular slot around the injector diffusor. The quantity of air supplied in relation to the water quantity flowing through is rather small, which means that a foam of high water content is formed, i.e. a foam of rather short duration. The big excess of water in the foam furthermore causes the detergent to be heavily diluted resulting in an inferior cleansing effect.

PURPOSE AND MOST ESSENTIAL FEATURES OF THE INVENTION

The purpose of the present invention is to provide a device in known washing and rinsing apparatuses, which can be used for low pressure apparatuses, operating at the pressure of the water mains, as well as for high pressure apparatuses (water pressure of between 50 and 200 bar) and with which a foam treatment, i.e. dissolving of the "dirt" with foamed detergent can be effected, whereby the water consumption is as low as possible and therefore also the quantity of detergent supplied, and which quantity can furthermore be controlled. Another purpose is to provide a device by means of which it is possible to create a rich foam of long duration and also by shifting a valve making possible rinsing with the same equipment and without limitation of the water quantity. These tasks have been solved in that the spray nozzle of the injector is designed with an elongated, cross-sectionally very small hole, adapted to press the driving medium as a very thin jet into the diffusor of the injector, that the diffusor is slightly conical and on the inlet side provided with a portion of bigger, preferably much bigger cross-sectional area than the hole of the spray nozzle and that the diffusor is arranged to open in an expansion chamber, to which is connectable a pressurized gas, e.g. air, for transport of the foam created therein to said nozzle.

DESCRIPTION OF THE DRAWINGS

The invention will hereinafter be further described with reference to an embodiment.

DESCRIPTION OF EMBODIMENT

Figure 1:
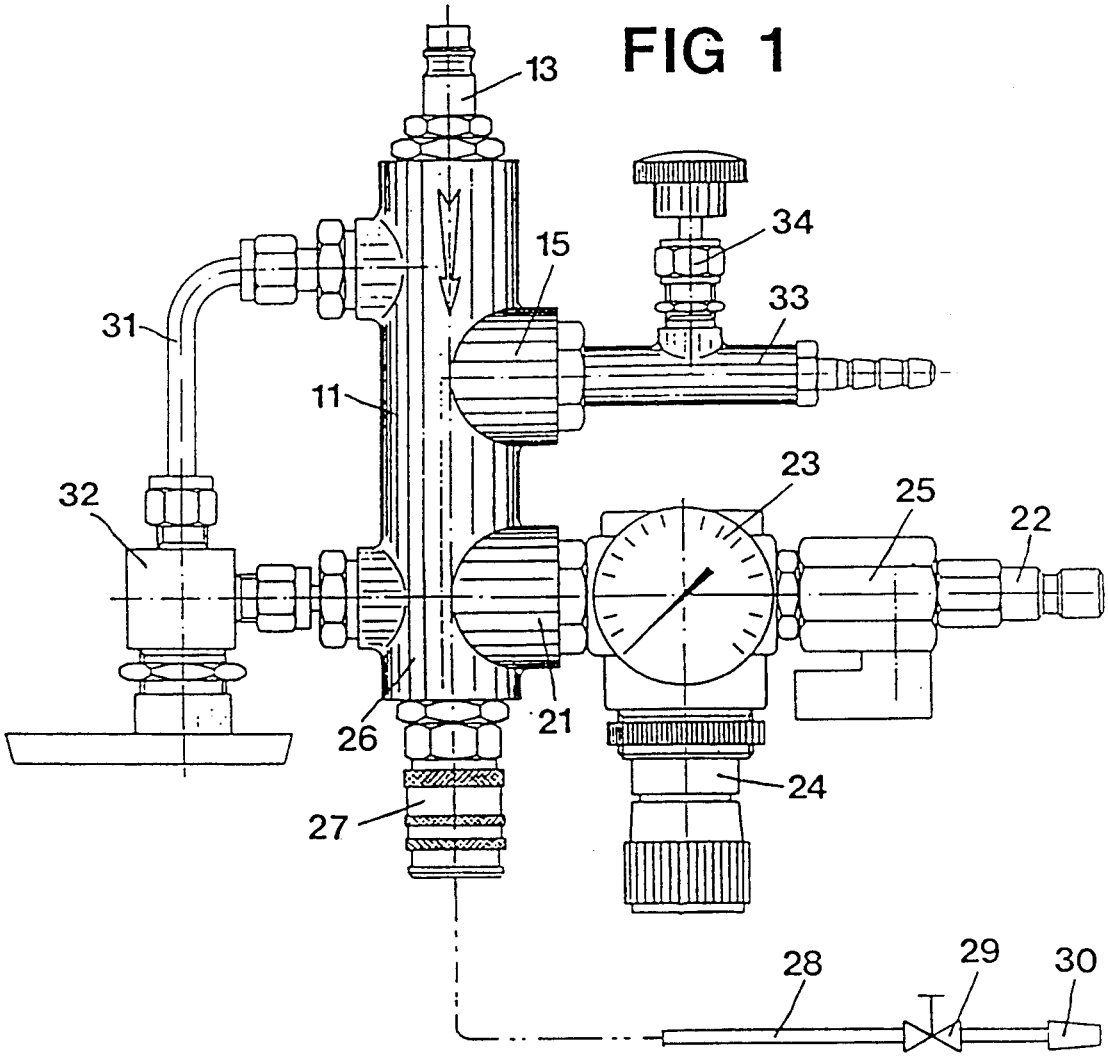
FIG. 1 shows the device according to the invention in a front view.
Figure 2:
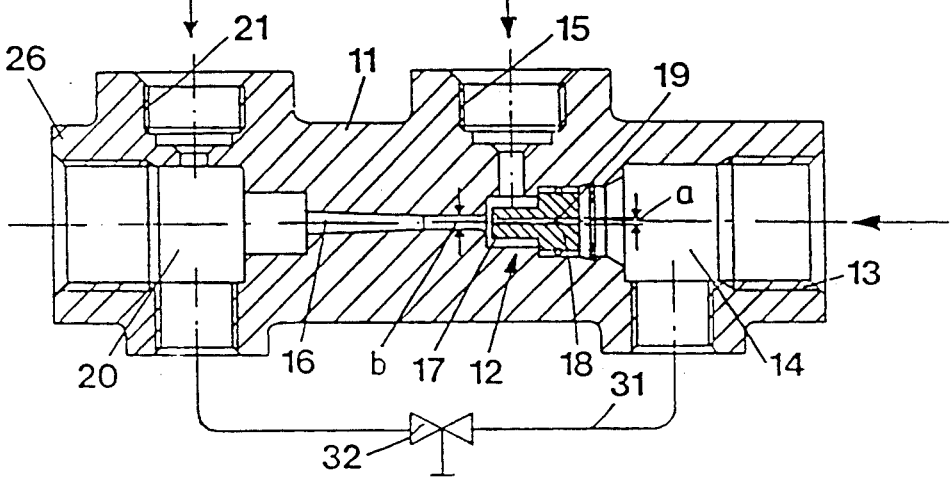
FIG. 2 shows a section through the valve body according to FIG. 1 in a somewhat bigger scale.

The device according to the invention consists of a valve body 11 in which is included an injector 12 having on the pressure side 14 a connection 13 for a driving medium and on the suction side, a connection 15 for a detergent. The driving medium in most cases is water under pressure. Behind the diffusor 16 of the injector as seen the direction of water flow is a room 17 in which is arranged the spray nozzle 18 of the injector. This spray nozzle is a plug provided with a central hole 19 and resting with a shoulder against a corresponding stop in the valve body 11. The spray nozzle 18 is sealed off against the pressure chamber 14 and its front part is almost cylindrical, thus that the water jet emitted by the spray nozzle 18 through the hole 19 will have time to fill the diffusor 16 before it enters an expansion chamber 20 provided in connection to the diffusor. The cross section of the chamber 20 is much greater than that of the outlet end of the diffusor 16. A pressure gauge 23 with pressure regulator 24 and a stop valve 25 are connectable to the expansion chamber via the socket 21.

At the front end of the valve body 11 a quick-coupling 27 for a hose is connectable to the socket 26, the hose having at its free end a lance 28 with a control valve 29 and a nozzle 30.

Between the pressure chamber 14 and the expansion chamber 20 is provided a by-pass conduit 31 having a closing and controlling valve 32, by means of which it is possible to by-pass the injector 12, which is then exerted to the same pressure at both sides, whereby the injector is made inactive, thus that the production of foam ceases. In this position the device according to the invention is used for rinsing only.

For adjustment of the quantity of detergent supplied there is provided a quantity control valve 34 in the suction conduit 33, which is connected to the connection 15.

It has proven itself that the size ratio between the hole 19 of the spray nozzle 18, i.e. the hole diameter a and the diffusor cross-section b, at its inlet part and the pressure at which the driving medium, i.e. the water is supplied are of importance for producing an optimum quantity of foam. At a pressure of 100–200 bar it has been found that a diameter a in the bore 19 of 0.8 mm and a diffusor diameter b of 1.6 mm are appropriate. If the water pressure is between 40 and 99 bar then a shall be 1.0 mm and b 1.6 mm. At water pressure between 15 and 39 bar the measure b shall be 2.3 mm and the hole diameter a 1.6 mm, whereas for a water pressure between 5 and 14 bar a shall be 1.8 mm and b 2.3 mm.

In this manner it is possible to cover the entire pressure range (from 5–200 bar) with two different valve bodies 11, one having a diffusor diameter b of 1.6 mm and another wherein the measure b is 2.3 mm, and four different injector spray nozzles 18.

OPERATING MODE OF THE DEVICE

When the stop valve 32 in the by-pass conduit 31 is in closed position, the pressurized water via the spray nozzle 18 will form a jet, which in the suction chamber 17 creates a sub-pressure, sucking in detergent in a quantity corresponding to the position of the control valve 34. The water-detergent admixture, which, at a certain chosen size relation between the spray nozzle and the diffusor, can be e.g. 4 to 5 liters per minute, builds up a counter-pressure in the diffusor, which is balanced against the pressurized air flowing into the expansion chamber 20 via the conduit 22. An air pressure of about 5–6 bar at an air quantity of about 50 liters per minute has proven itself to give an optimum quantity of foam. The quantities of detergent and of air are adjusted due to the foam pattern desired, to the importance of the throwing length and to how rigid the foam shall be. By suitable choice of lance 28 and nozzle 30 it is furthermore possible to adjust the quantity of foam during work.

I claim:

1. A washing and rinsing apparatus for continuously creating foam and for conveying the foam to a dispensing nozzle, the apparatus comprising:

a conical diffusor which has an inlet end and an outlet end which is larger than the inlet end;

a spray nozzle for spraying a thin jet of driving medium into the inlet end of the diffusor, the spray nozzle being in the form of an elongated hole having an outlet end, the cross section of the elongated hole being much smaller than the cross section of the inlet end of the diffusor, the spray nozzle having a pressure side and a suction side, the pressure side being connectable to means for supplying the driving medium, the suction side being connectable to means for supplying liquid, foam-forming detergent; and an expansion chamber at the outlet end of the diffusor, the expansion chamber having means at a point downstream from the diffusor outlet end for connection to a source of compressed gas for conveying the foam from the expansion chamber to the dispensing nozzle.

2. The apparatus of claim 1, wherein the driving medium is pressurized water, the compressed gas being pressurized air.

3. The apparatus of claim 2, wherein the spray nozzle is a separate plug with a shoulder for separating the pressure side from the suction side.

4. The apparatus of claim 2, further comprising a bypass conduit between the pressure side and the expansion chamber, the bypass conduit having a stop valve.

5. The apparatus of claim 1, wherein the ratio of the elongated hole diameter to the diffusor inlet diameter is substantially between 0.8:1.6 and 1.8:2.3.

6. The apparatus of claim 1, wherein at least a portion of said expansion chamber is immediately at the outlet end of the diffusor.

7. The apparatus of claim 1, wherein said spray nozzle includes an elongated injector within which said elongated hole is defined, and said suction side includes a chamber which surrounds said injector upstream of said elongated hole outlet and in which chamber the liquid detergent is received.

* * * * *